US011255542B2

(12) United States Patent
Metker et al.

(10) Patent No.: US 11,255,542 B2
(45) Date of Patent: Feb. 22, 2022

(54) DEVICE FOR HANDLING COMBUSTION GAS

(71) Applicant: Pittway Sarl, Rolle (CH)

(72) Inventors: Clemens Metker, Bad Iburg (DE); Sybrandus B. V (Wim) Munsterhuis, Dalen (NL); Gerrit Jan Baarda, Emmen (NL); Andreas Kammerahl, Lemfoerde (DE); Martin Petersmann, Osnabrueck (DE); Anton Quatmann, Vechta (DE); Ulrich Oldehus, Lohne (DE)

(73) Assignee: Pittway Sarl, Rolle (CH)

( * ) Notice: Subject to any disclaimer, the term of this patent is extended or adjusted under 35 U.S.C. 154(b) by 0 days.

(21) Appl. No.: 16/910,490

(22) Filed: Jun. 24, 2020

(65) Prior Publication Data

US 2020/0408405 A1 Dec. 31, 2020

(30) Foreign Application Priority Data

Jun. 28, 2019 (EP) ..... 19183158

(51) Int. Cl.
*F23N 5/24* (2006.01)

(52) U.S. Cl.
CPC ..... *F23N 5/24* (2013.01)

(58) Field of Classification Search
None
See application file for complete search history.

(56) References Cited

U.S. PATENT DOCUMENTS

2009/0165871 A1 7/2009 Struyk

FOREIGN PATENT DOCUMENTS

| | | | |
|---|---|---|---|
| CN | 103 050 895 | A | 4/2013 |
| DE | 94 10 070 | U1 | 10/1995 |
| JP | 2013-007564 | A | 1/2013 |

OTHER PUBLICATIONS

European Search Report of the Intellectual Property Office of Europe for EP19183158.5 dated Nov. 12, 2019.
Notice of Intent to Grant and Text Intended to Grant from counterpart European Application No. 19183158.5 dated Dec. 13, 2021, 49 pp.

*Primary Examiner* — Jason Lau
(74) *Attorney, Agent, or Firm* — Shumaker & Sieffert, P.A.

(57) ABSTRACT

A device for handling combustion gas comprises: a housing, a first electronic element, a second electronic element, a connecting element, and a sealing element. The housing defines a gas chamber for the combustion gas and an ambient chamber for ambient air. The first electronic element is positioned within the gas chamber and is exposed to the combustion gas. The second electronic element is positioned within the ambient chamber and is not exposed to the combustion gas but is exposed to the ambient air. The connecting element electrically connects the first electronic element and the second electronic element. The sealing element is made at least partially from an elastomer, and is compressed between the connecting element and the housing, and seals the gas chamber against the ambient chamber even if electrically insulating material of the connecting element or the connecting element is removed.

10 Claims, 3 Drawing Sheets

DEVICE FOR HANDLING COMBUSTION GAS

CROSS-REFERENCE TO RELATED APPLICATIONS

This application claims the benefit of EP Patent Application No. 19183158.5 filed on Jun. 28, 2019, the disclosure of which is herein incorporated by reference in its entirety.

The invention relates to a device for handling combustion gas.

Devices for handling combustion gas are especially used to provide combustion gas to a gas burner of a gas burner appliance. Such a gas burner appliance may be installed in a residential heating system. Such devices for handling combustion gas are also often called gas armatures.

The gas armatures may comprise an electronic element which is positioned within a gas chamber of the gas armature. Such an electronic element may be a sensor or an actuator. Such an electronic element which is positioned within combustion gas needs to be electrically connected to another electronic element which is not positioned within a gas chamber of the gas armature. The electronic element which is not positioned within the gas chamber of the gas armature is positioned within the ambient.

For the electrical connection of an electronic element being positioned within the gas chamber of the gas armature with an electronic element being positioned within the ambient, it is necessary to have a gas tight lead-through of electrical conductors or electrical paths from the gas chamber into the ambient.

Gas tight lead-throughs of electrical conductors from a gas chamber into the ambient which are known from practical use require a complex shaped sealing. Nevertheless, even when such a lead-through has such a complex shaped sealing, the lead-through of electrical conductors known from practical use can usually not fulfil safety regulations which require that the lead-through need to remain gas tight even if all non-metal or non-ceramic components and all non-elastomer components have been removed. A gas tight lead-through is also often called gas tight-out.

Against this background, a novel device for handling combustion gas is provided which provides a simple gas tight lead-through of electrical conductors from a gas chamber into the ambient and which fulfils safety regulations.

The device for handling combustion gas according to the present application comprises a housing made from metal. Said housing has a first housing part and a second housing part. Said housing defines a gas chamber for combustion gas and an ambient chamber for ambient air.

The device for handling combustion gas according to the present application further comprises a first electronic element positioned within the gas chamber, wherein said first electronic element is exposed to the combustion gas. The device for handling combustion gas according to the present application further comprises a second electronic element positioned within the ambient chamber, wherein said second electronic element is not exposed to the combustion gas but exposed to the ambient air.

The device for handling combustion gas according to the present application further comprises a connecting element for electrically connecting the first electronic element and the second electronic element. Said connecting element has electrical conductive paths, connecting the first electronic element and the second electronic element, being at least partially in connection with an electrically insulating material.

The device for handling combustion gas according to the present application further comprises a sealing element made at least partially from an elastomer. Said sealing element abuts on the connecting element and abuts on the housing, wherein said sealing element is compressed between the connecting element and the housing, and wherein said sealing element seals the gas chamber against the ambient chamber even if the electrically insulating material of the connecting element or the connecting element is removed.

The novel device for handling combustion gas provides a simple gas tight lead-through of electrical conductors from a gas chamber into the ambient and fulfils safety regulations.

According to a preferred embodiment, the connecting element has a thickness being adapted such that the compressed sealing element seals the gas chamber against the ambient chamber even if the electrically insulating material of the connecting element or the connecting element is removed. These features provide a simple gas tight lead-through of electrical conductors from a gas chamber into the ambient fulfilling safety regulations.

According to a preferred embodiment, the connecting element is fixedly attached to a support member. The support member is least partially made from metal or a ceramic material, namely at least in a region to which the connecting element is attached. The electrical conductive paths of the connecting element are electrically insulated against the support member by the electrically insulating material. These features provide a simple gas tight lead-through of electrical conductors from a gas chamber into the ambient fulfilling safety regulations.

According to a preferred embodiment, the support member has a first side, an opposite second side and an edge region extending between the first side and the opposite second side. Preferably, the first electronic element, the second electronic element and the connecting element are all placed on the first side of the support member. The opposite second side of the support member abuts on the first housing part of the housing. A first side of elastomer sealing element abuts on the connecting element and abuts on the first housing part of the housing. An opposite second side of elastomer sealing element abuts on the second housing part of the housing. These features provide a simple gas tight lead-through of electrical conductors from a gas chamber into the ambient fulfilling safety regulations.

Preferred developments of the invention are provided by the dependent claims and the description which follows. Exemplary embodiments are explained in more detail on the basis of the drawing, in which:

Figure 1:
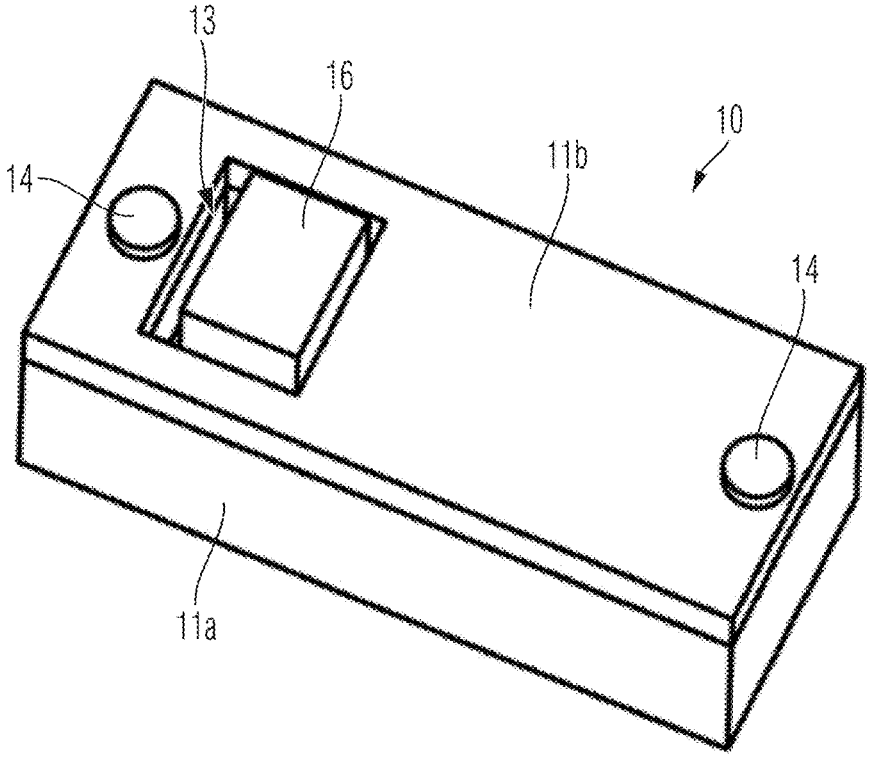
FIG. 1 shows a perspective view of a device for handling combustion gas according to a first embodiment of the invention.
Figure 2:
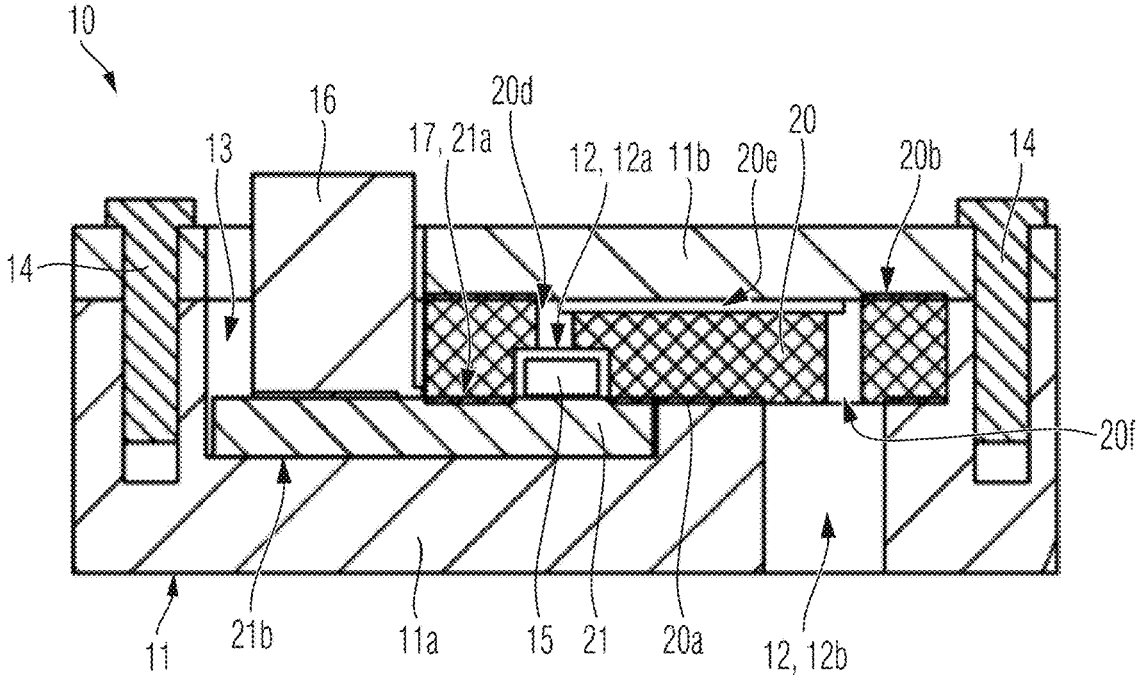
FIG. 2 shows a cross section of the device of FIG. 1.
Figure 3:
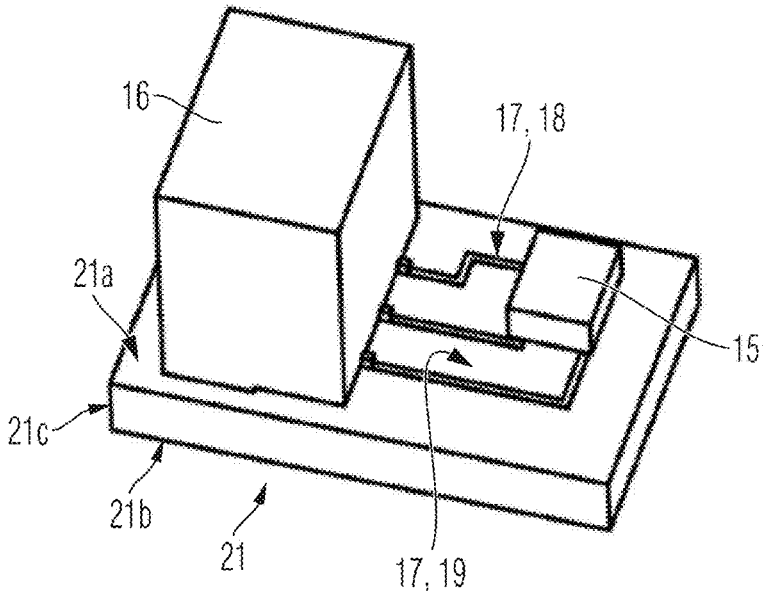
FIG. 3 shows a perspective view of a detail of the device of FIG. 1.
Figure 4:
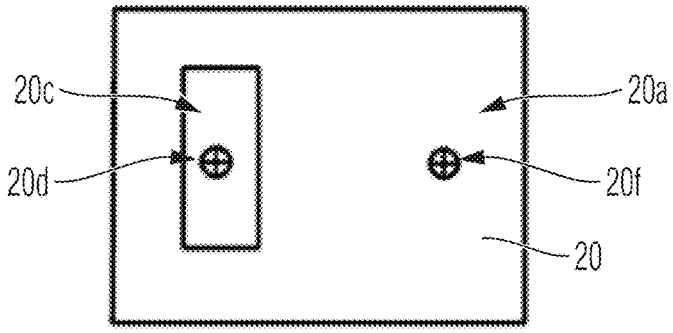
FIG. 4 shows a top view of a further detail of the device of FIG. 1.
Figure 5:
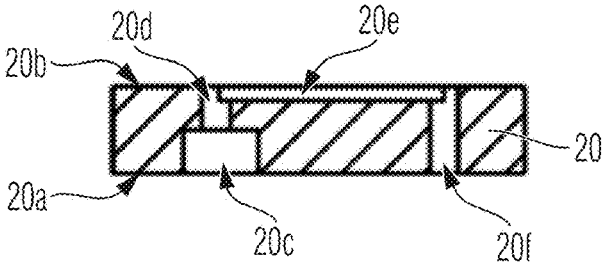
FIG. 5 shows a bottom view of the detail of FIG. 4.
Figure 6:
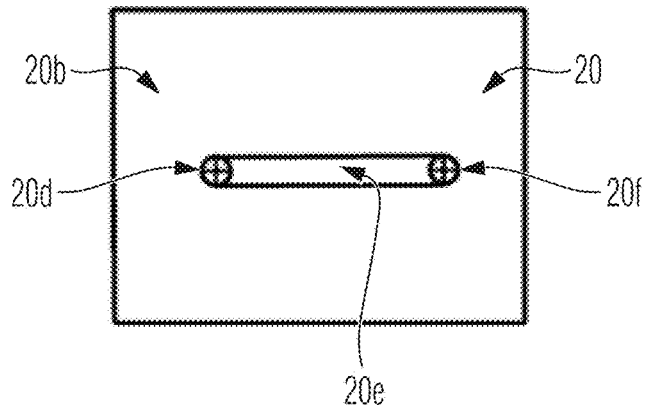
FIG. 6 shows a cross section of the detail of FIG. 4.

The present invention relates to a device 10 for handling combustion gas, especially to a gas armature for providing combustion gas to a gas burner of a gas burner appliance of a residential heating system.

The device 10 comprises a housing 11 made from metal. Said housing 10 has a first housing part 11*a* made from metal and a second housing part 11*b* made from metal. The housing 11 defines a gas chamber 12 for the combustion gas. The housing 11 further defines an ambient chamber 13 for ambient air.

The first housing part 11*a* and the second housing part 11*b* are mounted together by fastening elements 14 like screws, bolts, rivets or the like.

The device 10 comprises a first electronic element 15 positioned within the gas chamber 12. Said first electronic element 15 is exposed to the combustion gas. The device 10 further comprises a second electronic element 16 positioned within the ambient chamber 13. Said second electronic element 16 is not exposed to the combustion gas but is exposed to the ambient air.

The first electronic element 15 may be a sensor like a gas sensor or an actuator like a gas valve. The second electronic element 16 may be jack socket for receiving a plug connector through which the first electronic element 15 is connectable to a controller element.

The device 10 comprises a connecting element 17 for electrically connecting the first electronic element 15 and the second electronic element 16. Said connecting element 17 has electrical conductive paths 18 being at least partially in connection with, preferably being at least partially embedded in, an electrically insulating material 19.

The device 10 comprises a sealing element 20 made at least partially from an elastomer. Said sealing element 20 abuts on the connecting element 17 and abuts on the housing 11. Said sealing element 20 is compressed between the two housing parts 11*a*, 11*b* and thereby between the connecting element 17 and the housing 11. The sealing element 20 seals the gas chamber 12 against the ambient chamber 13 even if the electrically insulating material of the connecting element 17 or the entire connecting element 17 is removed.

A sealing element 20 made at least partially from an elastomer is herein called elastomer sealing element 20. Such an elastomer sealing element 20 can be made completely or partially from an elastomer material.

The connecting element 17 has a thickness being adapted such that the compressed sealing element 20 seals the gas chamber 12 against the ambient chamber 13 even if the electrically insulating material of the connecting element 17 or the entire connecting element 17 is removed.

Preferably, the connecting element 17 is either fixedly attached to support member 21 or loosely arranged on a support member 21. Alternatively, the connecting element 17 is either fixedly attached to or loosely arranged on the first housing part 11*a*.

If the connecting element 17 is fixedly attached to support member 21, preferably a first layer of the electrically insulating material 19 is fixedly attached to a surface of the support member 21, then the electrical conductive paths 18 are arranged on said first layer of the electrically insulating material 19, and then a second layer of the electrically insulating material 19 is arranged on the paths 18 and the first layer of the electrically insulating material 19.

If the connecting element 17 is fixedly attached to first housing part 11*a*, preferably a first layer of the electrically insulating material 19 is fixedly attached to a surface of the first housing part 11*a*, then the electrical conductive paths 18 are arranged on said first layer of the electrically insulating material 19, and then a second layer of the electrically insulating material 19 is arranged on the paths 18 and the first layer of the electrically insulating material 19.

If the connecting element 17 is loosely arranged on a support member 21 or loosely arranged on the first housing part 11*a*, the same is preferably provided by a flexible printed circuit board also often called Flex-PCB. The flexible printed circuit board is then loosely arranged on a surface of the support member 21 or loosely arranged on a surface of the first housing part 11*a*.

FIGS. 2 to 6 show an embodiment in which the connecting element 17 is fixedly attached to or loosely arranged on a plate like support member 21. The support member 21 can also be called support plate. The support member 21 is last least partially made from metal, preferably from aluminium, or from a ceramic material, namely at least in a region to which the connecting element 17 is attached or on which the connecting element 17 is arranged.

The electrical conductive paths 18 of the connecting element 17 are electrically insulated against the support member 21 by the electrically insulating material 19 with which the electrical conductive paths 18 are at least partially in connection with or in which the electrical conductive paths 18 are at least partially embedded.

The support member 21 has a first side 21*a*, an opposite second side 21*a* and an edge region 21*c* extending between the first side 21*a* and the opposite second side 21*b*. In FIGS. 2 to 6, the first electronic element 15, the second electronic element 16 and the connecting element 17 are all placed on the first side 21*a* of the support member 21.

The first electronic element 15 and the second electronic element 16 are preferably directly attached or directly mounted or directly fixes to the support member 21.

The second side 21*b* of the support member 21 abuts on the first housing part 11*a* of the housing 11.

A first side 20*a* of elastomer sealing element 20 abuts on the connecting element 17 and abuts on the first housing part 11*a* of the housing 11. An opposite second side 20*b* of elastomer sealing element 20 abuts on the second housing part 11*b* of the housing 11.

The elastomer sealing element 20 is compressed between the two housing parts 11*a*, 11*b* as well as between the support member 21 and the housing part 11*b*. Even if the electrically insulating material of the connecting element 17 or the entire connecting element 17 is removed, the elastomer sealing element 20 seals the gas chamber 12 against the ambient chamber 13. So, the gas tight lead-through of electrical conductors or paths 18 remains gas tight even if the electrically insulating material of the connecting element 17 or the entire connecting element 17 is removed.

Sealing contacts are established only between the elastomer sealing element 20 and the metal housing 11 and/or between the elastomer sealing element 20 and the support member 21 and between the elastomer sealing element 20 and the connecting element 17. As mentioned above, the support member 21 is preferably made from metal, alternatively from a ceramic material.

The connecting element 17 has a thickness being adapted such that the compressed sealing element 20 seals the gas chamber 12 against the ambient chamber 13 even if the electrically insulating material of the connecting element 17 or the entire connecting element 17 is removed. So, the compressed elastomer sealing element 20 is adapted to compensate for a potential gap between the elastomer sealing element 20 and the support member 21 when the connecting element 17 is removed.

As mentioned above, in FIGS. 2 to 6 the first electronic element 15, the second electronic element 16 and the connecting element 17 are all placed on the first side 21*a* of the support member 21. An opening 20*c* within the sealing element 20 provides a sub-chamber 12*a* of the gas chamber 12 in which the first electronic element 15 is positioned. Said sub-chamber 12*a* in which the first electronic element 15 is accommodated is connected with another sub-chamber 12*b* of the gas chamber 12 through openings 20*d*, 20*e* and 20*f* within the sealing element 20.

The openings 20*f*, 20*e*, 20*d* of the sealing element 20 provide a channel within the sealing element 20 to guide the combustion gas from the sub-chamber 12*b* to the sub-chamber 12*a* and to the first electronic element 15 positioned within said sub-chamber 12*a*.

The device 10 can be connected e.g. to a gas pipe or the like through the housing part 11*b* in such a manner the sub-chamber 12*b* of the gas chamber 12 communicates with a gas chamber of the gas pipe or the like.

As mentioned above, the support member 21 is made completely or partially of metal or from a ceramic material, so that even when all non-metallic and non-ceramic components are removed, the sealing points between the support member 21 and the sealing element 20 and between the sealing element 20 and the housing 11 remain unaffected.

Figure 7:
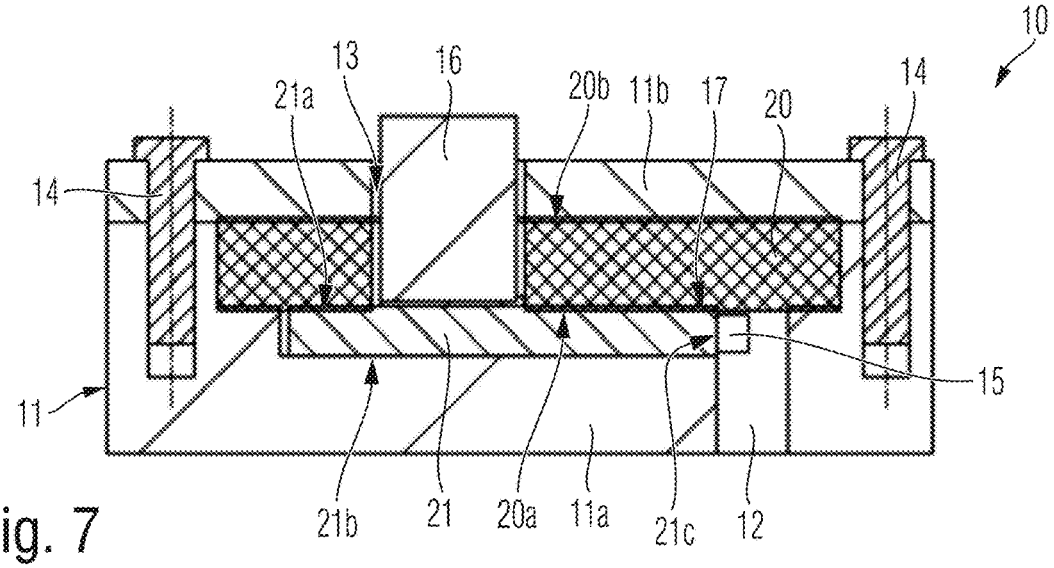
FIG. 7 shows a cross section of the device for handling combustion gas according to a second embodiment of the invention.

FIG. 7 shows also an embodiment in which the connecting element 17 is fixedly attached to or loosely arranged on a plate like support member 21. However, in FIG. 7, the second electronic element 16 is placed on the first side 21*a* of the sup-port member 21 while the first electronic element 15 is placed on the edge region 21*c* of the support member 21. In FIG. 7, the second side 21*b* of the support member 21 abuts on the first housing part 11*a* of the housing 11. A first side 20*a* of the elastomer sealing element 20 abuts on the connecting element 17 and abuts on the first housing part 11*a* of the housing 11. An opposite second side 20*b* of the elastomer sealing element 20 abuts on the second housing part 11*b* of the housing 11. In FIG. 7, the connecting element 17 connecting the first electronic element 15 with the second electronic element 16 extends over different surfaces of the support member 21, namely over a surface of the first side 21*a* and the edge region 21*c* of the support member 21. The electrical conductors or paths 18 are lead around the support member 21.

In FIG. 7, the sealing element 20 has an opening accommodating the second electronic element 16. This opening defines the ambient chamber 13. In FIG. 7, the sealing element 20 does not have openings for guiding the combustion gas.

Figure 8:
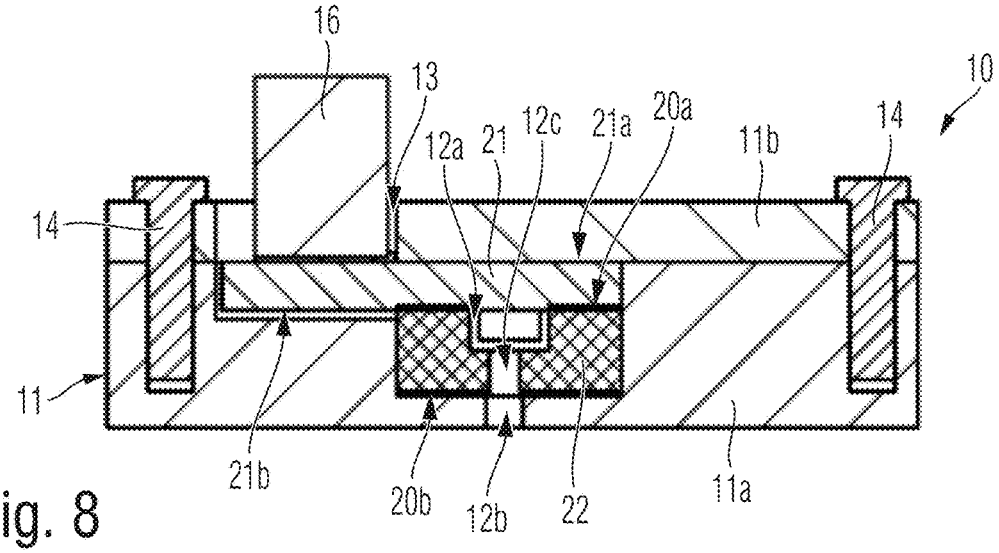
FIG. 8 shows a cross section of the device for handling combustion gas according to a third embodiment of the invention.

FIG. 8 shows another embodiment in which the connecting element 17 is fixedly attached to a plate like support member 21. In FIG. 8, the second electronic element 16 is placed on the first side 21*a* of the support member 21 while the first electronic element 15 is placed on the second side 21*b* of the support member 21.

In FIG. 8, the second electronic element 16 is placed on the first side 21*a* of the support member 21 and the first electronic element 15 is placed on the second side 21*b* of the support member 21.

In FIG. 8, the connecting element 17 connecting the first electronic element 15 with the second electronic element 16 extends over different surfaces of the support member 21, namely over a surface of the first side 21*a* and the second side 21*b* of the support member 21. The electrical conductors or paths 18 are lead through the support member 21.

In FIG. 8, the first side 21*a* of the support member 21 abuts on the second housing part 11*b* of the housing 11. A first side 20*a* of the elastomer sealing element 20 abuts on the connecting element 21 and abuts on the second side 21*b* of the support member 21. An opposite second side 20*b* of the elastomer sealing element 20 abuts on the first housing part 11*a* of the housing 11. In FIG. 8, the sealing element 20 has an opening accommodating the first electronic element 15. This opening defines the sub-chamber 12*a* of the gas chamber 12. The sub-chamber 12*a* of the gas chamber 12 is connected with the sub-chamber 12*b* through an opening 12*c* of the sealing element 20.

Figure 9:
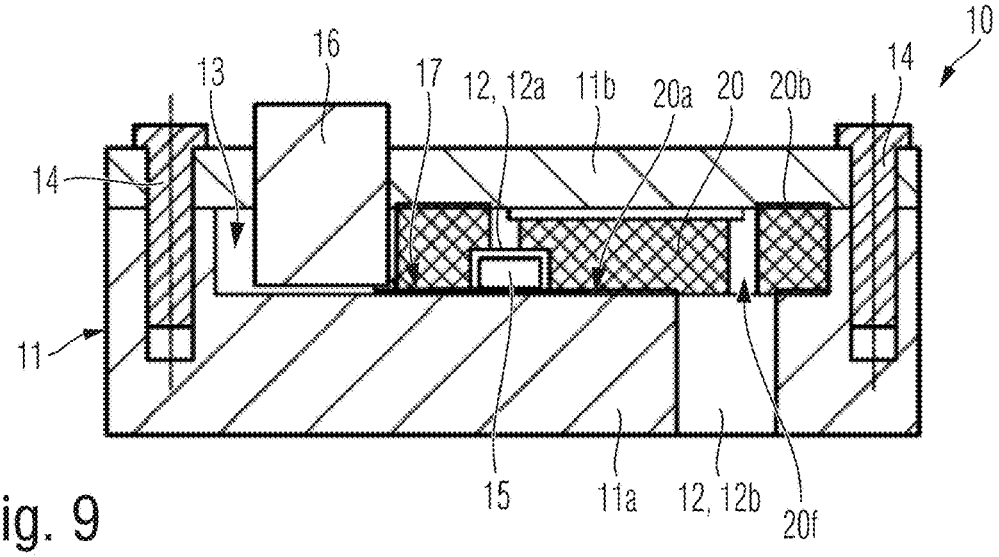
FIG. 9 shows a cross section of the device for handling combustion gas according to a fourth embodiment of the invention.

FIG. 9 shows an embodiment in which the connecting element 17 is loosely arranged on the first housing part 11*a* of the housing 11. In FIG. 9 these is no separate support member 21. The first metal housing part 11*a* acts as metal support member for the connecting element 17.

In FIG. 9, at least one of the first electronic element 15 and the second electronic element 16 is, preferably both are, positioned on a first side of the connecting element 17. The opposite second side of the connecting element 17 abuts on the first housing part 11*a* of the housing 11. A first side 20*a* of the elastomer sealing element 20 abuts on the connecting element 17 and abuts on the first housing part 11*a* of the housing 11.

An opposite second side 20*b* of the elastomer sealing element 20 abuts on the second housing part 11*b* of the housing 11. All other details of the embodiment of FIG. 9 correspond to the embodiment of FIG. 1-6.

In all shown embodiments sealing contacts are established only between the elastomer sealing element 20 and the metal housing 11 and/or between the elastomer sealing element 20 and the support member 21 and further between the elastomer sealing element 20 and the connecting element 17. The elastomer sealing element 20 covers the connecting element 17 in such a way that the first electronic element 15 is positioned in the combustion gas chamber 12 and the second electronic element 16 is positioned outside the combustion gas chamber 12 but within the ambient chamber 13. The connecting element 17 has a thickness being adapted such that the compressed sealing element 20 seals the gas chamber 12 against the ambient chamber 13 even if the connecting element 17 is removed. So, the compressed elastomer sealing element 20 is adapted to compensate for a potential gap between the elastomer sealing element 20 and the support member 21 or between the elastomer sealing element 20 and the housing 11 when the connecting element 17 is removed.

LIST OF REFERENCE SIGNS

10 device
11 housing
11*a* first housing part
11*b* second housing part
12 gas chamber
12*a* sub-chamber
12*b* sub-chamber
13 ambient chamber
14 fastening element
15 first electronic element
16 second electronic element
17 connecting element
18 path
19 insulating material
20 sealing element
20*a* first side

20*b* second side
20*c* openings
20*d* openings
20*e* openings
20*f* openings
21 support member
21*a* first side
21*b* second side
21*c* edge region

The invention claimed is:

1. A device configured to handle combustion gas, the device comprising:

a housing made from metal, wherein the housing has a first housing part and a second housing part, wherein the housing defines a gas chamber for the combustion gas, wherein the housing defines an ambient chamber for ambient air;

a first electronic element positioned within the gas chamber, wherein the first electronic element is configured to be exposed to the combustion gas;

a second electronic element positioned within the ambient chamber, wherein the second electronic element is not exposed to the combustion gas but is exposed to the ambient air;

a connecting element configured to electrically connect the first electronic element and the second electronic element, wherein the connecting element has electrically conductive paths at least partially in connection with an electrically insulating material; and a sealing element made at least partially from an elastomer, wherein the sealing element abuts on the connecting element and abuts on the housing, wherein the sealing element is compressed between the connecting element and the housing, and wherein the sealing element seals the gas chamber against the ambient chamber even if the electrically insulating material of the connecting element or the connecting element is removed.

2. The device of claim 1, wherein the connecting element has a thickness being adapted such that the compressed sealing element seals the gas chamber against the ambient chamber even if the electrically insulating material of the connecting element or the connecting element is removed.

3. The device of claim 1, wherein:

the connecting element is fixedly attached to or loosely arranged on a support member, the support member is last least partially made from metal or a ceramic material, at least in a region to which the connecting element is attached or in a region on which the connecting element is arranged, and the electrical conductive paths of the connecting element are electrically insulated against the support member by the electrically insulating material.

4. The device of claim 3, wherein:

the support member has a first side, an opposite second side, and an edge region extending between the first side and the opposite second side, the first electronic element, the second electronic element, and the connecting element are all placed on the first side of the support member, the second side of the support member abuts on the first housing part of the housing, a first side of the sealing element abuts on the connecting element and abuts on the first housing part of the housing, and an opposite second side of the sealing element abuts on the second housing part of the housing.

5. The device of claim 3, wherein:

the support member has a first side, an opposite second side, and an edge region extending between the first side and the opposite second side, the second electronic element is placed on the first side of the support member, the first electronic element is placed on the second side of the support member or is placed on the edge region of the support member, the second side of the support member abuts on the first housing part of the housing, a first side of the sealing element abuts on the connecting element and abuts on the first housing part of the housing, and an opposite second side of the sealing element abuts on the second housing part of the housing.

6. The device of claim 3, wherein:

the support member has a first side, an opposite second side, and an edge region extending between the first side and the opposite second side, the second electronic element is placed on the first side of the support member, the first electronic element is placed on the second side of the support member, the first side of the support member abuts on the second housing part of the housing, a first side of the sealing element abuts on the connecting element and abuts on the second side of the support member, and an opposite second side of the sealing element abuts on the first housing part of the housing.

7. The device of claim 1, wherein:

the connecting element is loosely arranged on the first housing part of the housing, at least one of the first electronic element or the second electronic element is positioned on a first side of the connecting element, the opposite second side of the connecting element abuts on the first housing part of the housing, a first side of the sealing element abuts on the connecting element and abuts on the first housing part of the housing, and an opposite second side of the sealing element abuts on the second housing part of the housing.

8. The device of claim 1, wherein the first electronic element is a sensor.

9. The device of claim 1, wherein the first electronic element is an actuator.

10. The device of claim 1, wherein the second electronic element is a jack socket configured to receive a plug connector.

* * * * *